US005993551A

United States Patent [19]

Hahn

[11] Patent Number: 5,993,551

[45] Date of Patent: Nov. 30, 1999

[54] ROOF TILE AND METHOD AND APPARATUS FOR PROVIDING SAME

[75] Inventor: Eric Martin Hahn, Aliso Viejo, Calif.

[73] Assignee: Boral Industries, Inc., Atlanta, Ga.

[21] Appl. No.: 08/869,868

[22] Filed: Jun. 2, 1997

[51] Int. Cl.[6] ..... B05B 7/06; D06B 1/00

[52] U.S. Cl. ..... 118/315; 118/314; 68/205 R

[58] Field of Search ..... 427/186, 187, 427/188, 421, 424, 425; 119/323, 324, 621, 629, 241, 242, 243, 313–315; 68/200, 201, 205 R

[56] References Cited

U.S. PATENT DOCUMENTS

| | | |
|---|---|---|
| D. 27,761 | 10/1897 | Mark . |
| 34,586 | 5/1862 | Weil et al. . |
| 147,061 | 2/1874 | Manvel . |
| D. 282,288 | 1/1986 | Bates . |
| D. 283,551 | 4/1986 | Repasky . |
| D. 320,091 | 9/1991 | Paquette . |
| D. 321,942 | 11/1991 | Lynn . |
| D. 338,541 | 8/1993 | Fifield . |
| D. 347,483 | 5/1994 | Thomas . |
| D. 356,873 | 3/1995 | Bamber et al. . |
| D. 370,549 | 6/1996 | Treat . |
| 479,442 | 7/1892 | Marvick . |
| 491,625 | 2/1893 | Wutke . |
| 1,427,968 | 9/1922 | Pederson . |
| 1,454,070 | 5/1923 | Openshaw . |
| 1,993,086 | 3/1935 | Chaffee . |
| 2,340,038 | 1/1944 | Buczkowski et al. . |
| 2,510,416 | 6/1950 | Pretty . |
| 2,624,298 | 1/1953 | Farren . |
| 3,267,823 | 8/1966 | MacRae . |
| 3,440,777 | 4/1969 | Martin . |
| 3,740,914 | 6/1973 | Arnaiz Diez . |

(List continued on next page.)

FOREIGN PATENT DOCUMENTS

| | | |
|---|---|---|
| 70225 | 3/1992 | Canada . |
| 0088198 A2 | 9/1983 | European Pat. Off. . |
| 0115374 A2 | 8/1984 | European Pat. Off. . |
| 0175500 A1 | 3/1986 | European Pat. Off. . |
| 0236585 A1 | 9/1987 | European Pat. Off. . |
| 0375802 A1 | 7/1990 | European Pat. Off. . |
| 1259641 | 8/1961 | France . |
| 0 095 420 A1 | 11/1983 | France . |
| 93888 | 12/1896 | Germany . |
| D-9215 | 6/1990 | Ireland . |
| 216948 | 2/1988 | New Zealand . |
| 1 569 978 | 6/1980 | Switzerland . |
| 416649 | 10/1934 | United Kingdom . |
| 483969 | 3/1938 | United Kingdom . |
| 896450 | 6/1960 | United Kingdom . |
| 995692 | 7/1963 | United Kingdom . |
| 1 020 013 | 7/1965 | United Kingdom . |
| 2046808 | 11/1980 | United Kingdom . |
| 1586369 | 3/1981 | United Kingdom . |
| 2111550 | 7/1983 | United Kingdom . |
| 2123058 | 1/1984 | United Kingdom . |
| 2178773 | 2/1987 | United Kingdom . |
| 2245613 | 1/1992 | United Kingdom . |
| WO89/06728 | 7/1989 | WIPO . |

*Primary Examiner*—Richard Crispino
*Assistant Examiner*—Calvin Padgett
*Attorney, Agent, or Firm*—Jones & Askew, LLP

[57] ABSTRACT

A clay tile or other formed item having a simulated appearance and a method and apparatus for providing same includes the use of perceptibly random spray patterns and multiple spray nozzles to dispense a coating liquid upon the item prior to its drying and possible firing. Upon drying, the tiles processed thereby include improved appearance characteristics. Spraying is accomplished by a computer controlled spray system which includes, in one embodiment, multiple banks of spray guns (as an example, three guns per bank) which spray liquid upon clay tiles or other items passing thereunder. The spray guns can oscillate sidewardly relative to the general path of the moving items, to further enhance the perceptibly random spray patterns. Different types of engobe or other coatings may be sprayed by each of the banks of spray guns. The method and apparatus can also be used in association with the coloration of clay brick, concrete roof tiles, concrete brick, and concrete block.

20 Claims, 12 Drawing Sheets

U.S. PATENT DOCUMENTS

| | | | |
|---|---|---|---|
| 3,873,225 | 3/1975 | Jakobsen . | |
| 3,899,855 | 8/1975 | Gadsby . | |
| 4,034,528 | 7/1977 | Sanders et al. . | |
| 4,065,899 | 1/1978 | Kirkuff . | |
| 4,130,974 | 12/1978 | Chalmers et al. . | |
| 4,185,939 | 1/1980 | Barth et al. . | |
| 4,279,106 | 7/1981 | Gleason et al. . | |
| 4,506,483 | 3/1985 | Phalen, Jr. . | |
| 4,535,579 | 8/1985 | Burgoyne et al. . | |
| 4,574,536 | 3/1986 | Bamber et al. . | |
| 4,731,969 | 3/1988 | Baker et al. . | |
| 4,738,068 | 4/1988 | Mendez . | |
| 4,743,471 | 5/1988 | Shills, III . | |
| 4,752,520 | 6/1988 | Franklin . | |
| 4,890,432 | 1/1990 | Shepherd . | |
| 4,899,514 | 2/1990 | Brookhart, Jr. . | |
| 4,932,184 | 6/1990 | Waller . | |
| 5,070,671 | 12/1991 | Fifield et al. . | |
| 5,214,895 | 6/1993 | Fifield . | |
| 5,268,028 | 12/1993 | Fifield . | |
| 5,395,442 | 3/1995 | Dunton et al. . | |
| 5,406,766 | 4/1995 | Nicholas et al. . | |
| 5,490,360 | 2/1996 | Fifield et al. . | |
| 5,502,940 | 4/1996 | Fifield . | |
| 5,603,758 | 2/1997 | Schreifels . | |
| 5,614,254 | 3/1997 | Murata et al. | 118/323 |
| 5,795,622 | 8/1998 | Belt et al. | 427/186 |

| | | | |
|---|---|---|---|
| FLASH | • CENTER GUN FROM BANK #1 SPRAYS ENTIRE LENGTH OF EVERY TILE<br>• NO OSCILLATION | • CENTER GUN FROM BANK #2 SPRAYS ENTIRE LENGTH OF EVERY TILE<br>• NO OSCILLATION | • INVALID SETTING; OPERATOR ALERTED |
| P82 | • CENTER GUN FROM BANK #1 SPRAYS ENTIRE LENGTH OF SIX (6) CONSECUTIVE TILES, THEN SKIPS FOUR (4) CONSECUTIVE TILES, REPEATS<br>• NO OSCILLATION | • CENTER GUN FROM BANK #2 SPRAYS ENTIRE LENGTH OF SIX (6) CONSECUTIVE TILES, THEN SKIPS FOUR (4) CONSECUTIVE TILES, REPEATS<br>• NO OSCILLATION | • INVALID SETTING; OPERATOR ALERTED<br>• |
| RANDOM | • BANK #1 GUNS SPRAY TILES WITH MULTIPLE (e.g., 25) SINGLE COLOR PATTERNS<br>• OSCILLATION | • BANK #2 GUNS SPRAY TILES WITH MULTIPLE (e.g., 25) SINGLE COLOR PATTERNS<br>• OSCILLATION | • BOTH BANKS #1 AND #2 SPRAY TILES WITH MULTIPLE (e.g., 25) TWO COLOR PATTERNS<br>• OSCILLATION |

*FIG. 9*

TWO COLOR PATTERN 1 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | | | | | | | | | | | | | | | |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | | | | | |
| | TOP | | | | | | | | | | | | | | | |
| | RIGHT | 1 | 1 | 1 | | | | | | | | 1 | 1 | 1 | 1 | 1 |

TWO COLOR PATTERN 2 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | | | | | | | | | | | | | | | |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | 1 | 1 | 1 | | | | | | | | 1 | 1 | 1 | 1 | 1 |
| | TOP | | | | | | | | | | | | | | | |
| | RIGHT | | | | | | | | | | | | | | | |

TWO COLOR PATTERN 3 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | 1 | 1 | 1 | | | | | | | | | | | | |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | 1 | | | | | | | | | | | | | | |
| | TOP | 1 | | | | | | | | | | | | | | |
| | RIGHT | 1 | | | | | | | | | | | | | | |

TWO COLOR PATTERN 4 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | | | | | | | | 1 | 1 | 1 | 1 | 1 | 1 | 1 | 1 |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | 1 | 1 | 1 | 1 | 1 |
| | TOP | | | | | | | | | | | | | | | |
| | RIGHT | | | | | | | | | | | 1 | 1 | 1 | 1 | 1 |

TWO COLOR PATTERN 5 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | | | | | | | | 1 | 1 | 1 | 1 | 1 | 1 | 1 | 1 |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | | | | | |
| | TOP | | | | | | | | 1 | 1 | 1 | 1 | 1 | 1 | 1 | 1 |
| | RIGHT | | | | | | | | | | | | | | | |

*FIG. 11*

TWO COLOR PATTERN 6 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | | | | | | | | | | | | | | | |
| | RIGHT | | | | | | | | | | | | | | | |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | 1 | 1 | 1 | 1 | 1 | 1 |
| | TOP | | | | | | | | | | | | | | | |
| | RIGHT | | | | | | | | | | | | | | | |

TWO COLOR PATTERN 7 OF 25

| | | | | | | | | | | | | | | | | |
|---|---|---|---|---|---|---|---|---|---|---|---|---|---|---|---|---|
| COLOR 1 SPRAY GUN | LEFT | | | | | | | | | | | | | | | |
| | TOP | | | | | | | | | | | | | | | |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | | | | | |
| | TOP | | | | | | | | | | | | | | | |
| | RIGHT | 1 | 1 | 1 | 1 | | | | | | | | | | | |

TWO COLOR PATTERN 8 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | | | | | | | | | | |
| | TOP | 1 | 1 | | | | | | | | | | | | | |
| | RIGHT | 1 | 1 | 1 | 1 | 1 | | | | | | | | | | |
| | | 15 | 14 | 13 | 12 | 11 | 10 | 9 | 8 | 7 | 6 | 5 | 4 | 3 | 2 | 1 |
| COLOR 2 SPRAY GUN | LEFT | 1 | | | | | | | | | | | | | | |
| | TOP | | | | | | | | | | | | | | | |
| | RIGHT | 1 | | | | | | | | | | | | | | |

TWO COLOR PATTERN 9 OF 25

| | | | | | | | | | | | | | | | | |
|---|---|---|---|---|---|---|---|---|---|---|---|---|---|---|---|---|
| COLOR 1 SPRAY GUN | LEFT | | | | | | | 1 | 1 | 1 | 1 | 1 | 1 | 1 | 1 | 1 |
| | TOP | | | | | | | | | | 1 | 1 | 1 | 1 | 1 | 1 |
| | RIGHT | | | | | | | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | 1 | 1 | 1 | 1 | 1 |
| | TOP | | | | | | | | | | | | | 1 | 1 | 1 |
| | RIGHT | | | | | | | | | | | 1 | 1 | 1 | 1 | 1 |

TWO COLOR PATTERN 10 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | 1 | 1 | 1 | 1 | 1 | 1 | 1 | 1 | 1 | 1 | 1 | 1 | 1 | 1 | 1 |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | 1 | 1 | 1 | 1 | 1 | | | | | | | | | | |
| | TOP | 1 | 1 | | | | | | | | | | | | | |
| | RIGHT | 1 | 1 | 1 | 1 | 1 | | | | | | | | | | |

FIG. 12

TWO COLOR PATTERN 11 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | 1 | 1 | | | | | | | | | | | | | |
| | RIGHT | 1 | 1 | 1 | 1 | 1 | 1 | 1 | | | | | | | | |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | | | | | |
| | TOP | 1 | | | | | | | | | | | | | | |
| | RIGHT | 1 | 1 | | | | | | | | | | | | | |

TWO COLOR PATTERN 12 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | | | | | | | | |
| | TOP | 1 | 1 | | | | | | | | | | | | | |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | | | | | |
| | TOP | 1 | | | | | | | | | | | | | | |
| | RIGHT | 1 | 1 | | | | | | | | | | | | | |

TWO COLOR PATTERN 13 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | | | | | | | | | | | 1 | 1 | 1 | 1 | 1 |
| | RIGHT | | | | | | | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | 1 | 1 | 1 | 1 | 1 |
| | TOP | | | | | | | | | | | | | | | |
| | RIGHT | | | | | | | | | | | 1 | 1 | 1 | 1 | 1 |

TWO COLOR PATTERN 14 OF 25

| | | | | | | | | | | | | | | | | |
|---|---|---|---|---|---|---|---|---|---|---|---|---|---|---|---|---|
| COLOR 1 SPRAY GUN | LEFT | | | | | | | 1 | 1 | 1 | 1 | 1 | 1 | 1 | 1 | 1 |
| | TOP | | | | | | | | | | | 1 | 1 | 1 | 1 | 1 |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | 1 | 1 | 1 | 1 | 1 |
| | TOP | | | | | | | | | | | | | | | |
| | RIGHT | | | | | | | | | | | 1 | 1 | 1 | 1 | 1 |

TWO COLOR PATTERN 15 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | | | | | | | | | | | | | | | |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | 1 | | | | | | | | | | 1 | 1 | 1 | 1 | 1 |
| | TOP | | | | | | | | | | | | | | | |
| | RIGHT | 1 | | | | | | | | | | 1 | 1 | 1 | 1 | 1 |

*FIG. 13*

TWO COLOR PATTERN 16 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | | | | | | | | | | | | |
| | TOP | 1 | 1 | 1 | 1 | 1 | 1 | | | | | | | | | |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | 1 | | | | | | | | | | | | | | |
| | TOP | 1 | 1 | | | | | | | | | | | | | |
| | RIGHT | 1 | 1 | 1 | | | | | | | | | | | | |

TWO COLOR PATTERN 17 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | 1 | 1 | 1 | 1 | 1 | 1 | | | | | | | | | |
| | RIGHT | 1 | 1 | 1 | | | | | | | | | | | | |
| | | 15 | 14 | 13 | 12 | 11 | 10 | 9 | 8 | 7 | 6 | 5 | 4 | 3 | 2 | 1 |
| COLOR 2 SPRAY GUN | LEFT | 1 | 1 | 1 | | | | | | | | | | | | |
| | TOP | 1 | 1 | | | | | | | | | | | | | |
| | RIGHT | 1 | | | | | | | | | | | | | | |

TWO COLOR PATTERN 18 OF 25

| | | | | | | | | | | | | | | | | |
|---|---|---|---|---|---|---|---|---|---|---|---|---|---|---|---|---|
| COLOR 1 SPRAY GUN | LEFT | | | | | | | | | | 1 | 1 | 1 | 1 | 1 | 1 |
| | TOP | | | | | | | 1 | 1 | 1 | 1 | 1 | 1 | 1 | 1 | 1 |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | | 1 | 1 | 1 | 1 |
| | TOP | | | | | | | | | | | 1 | 1 | 1 | 1 | 1 |
| | RIGHT | | | | | | | | | | 1 | 1 | 1 | 1 | 1 | 1 |

TWO COLOR PATTERN 19 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | | | | | | | 1 | 1 | 1 | 1 | 1 | 1 | 1 | 1 | 1 |
| | RIGHT | | | | | | | | | | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | 1 | 1 | 1 | 1 | 1 | 1 |
| | TOP | | | | | | | | | | | 1 | 1 | 1 | 1 | 1 |
| | RIGHT | | | | | | | | | | | | 1 | 1 | 1 | 1 |

TWO COLOR PATTERN 20 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | 1 | 1 | 1 | | | | | | | 1 | 1 | 1 | 1 | 1 | 1 |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | 1 | 1 | 1 | 1 | 1 |
| | TOP | | | | | | | | | | | | | | | |
| | RIGHT | | | | | | | | | | | 1 | 1 | 1 | 1 | 1 |

FIG. 14

TWO COLOR PATTERN 21 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | 1 | 1 | | | | | | | | | | | | | |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | 1 | 1 | 1 | 1 | 1 |
| | TOP | | | | | | | | | | | | | | | |
| | RIGHT | | | | | | | | | | | 1 | 1 | 1 | 1 | 1 |

TWO COLOR PATTERN 22 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | | | | | 1 | 1 | 1 | 1 | 1 | 1 | 1 | 1 | 1 | 1 | 1 |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | | | | | |
| | TOP | | | | | | | | | | | | | | | |
| | RIGHT | | | | | | | | | | | | | | | |

TWO COLOR PATTERN 23 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | | | | | | | | | |
| | TOP | | | | | | | | | | | | | | | |
| | RIGHT | | | | | | | | | | | | | | | |
| | | 15 | 14 | 13 | 12 | 11 | 10 | 9 | 8 | 7 | 6 | 5 | 4 | 3 | 2 | 1 |
| COLOR 2 SPRAY GUN | LEFT | 1 | 1 | | | | | | | | | | | | | |
| | TOP | | | | | | | | | | | | | | | |
| | RIGHT | | | | | | | | | | | | | | | |

TWO COLOR PATTERN 24 OF 25

| | | | | | | | | | | | | | | | | |
|---|---|---|---|---|---|---|---|---|---|---|---|---|---|---|---|---|
| COLOR 1 SPRAY GUN | LEFT | | | | | | | | | | | | | | | |
| | TOP | | | | | | | | | | | | | | | |
| | RIGHT | 1 | 1 | 1 | 1 | 1 | 1 | | | | | | | | | |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | | | | | | | |
| | TOP | | | | | | | | | | | | | | | |
| | RIGHT | 1 | 1 | | | | | | | | | | | | | |

TWO COLOR PATTERN 25 OF 25

| | | | | | | | | | | | | | | | | |
|---|---|---|---|---|---|---|---|---|---|---|---|---|---|---|---|---|
| COLOR 1 SPRAY GUN | LEFT | 1 | 1 | 1 | 1 | 1 | 1 | 1 | 1 | 1 | 1 | 1 | 1 | 1 | 1 | 1 |
| | TOP | 1 | 1 | 1 | 1 | 1 | 1 | 1 | 1 | 1 | 1 | 1 | 1 | 1 | 1 | 1 |
| | RIGHT | 1 | 1 | 1 | 1 | 1 | 1 | 1 | 1 | 1 | 1 | 1 | 1 | 1 | 1 | 1 |
| | | 15 | 14 | 13 | 12 | 11 | 10 | 9 | 8 | 7 | 6 | 5 | 4 | 3 | 2 | 1 |
| COLOR 2 SPRAY GUN | LEFT | | | | | | | | | 1 | 1 | 1 | 1 | 1 | 1 | 1 |
| | TOP | | | | | | | | | | 1 | 1 | 1 | 1 | 1 | 1 |
| | RIGHT | | | | | | | | | | | 1 | 1 | 1 | 1 | 1 |

*FIG. 15*

ROOF TILE AND METHOD AND APPARATUS FOR PROVIDING SAME

TECHNICAL FIELD

This invention relates in general to roof tiles, bricks, and blocks having simulated appearance characteristics, including variegated color characteristics, as well as a method and apparatus for providing same.

BACKGROUND OF THE INVENTION

It is well known to provide clay or concrete tiles for use atop or on the sides of dwellings or other structures. It is also well known to provide clay bricks and concrete blocks for use in veneer and structural applications, such as exterior dwelling walls.

There is a known need in the art to provide simulated appearances onto the to-be-exposed surfaces of such items, for purposes of defined appearances.

For example, in the instance of clay tiles, a wide color range similar to the that provided by periodic kilns is desired.

In the instance of clay bricks, a "used" or antique appearance can be desirable over a newer appearance. In each of these instances, the use of color variations within each item and between different sequentially produced items can be highly desirable, especially when such items can be made using otherwise conventional efficient manufacturing techniques.

Therefore it should be understood that a need exists for roof tiles, bricks, or concrete blocks which exhibit surface characteristics which are different from their traditional as-produced appearances.

SUMMARY OF THE INVENTION

The present invention overcomes deficiencies in the prior art by providing an apparatus and method for using same which provides means for applying discretely-sprayed, perceptually random liquid spray patterns onto said items to provide desired variegated surface appearances to same.

Therefore, it is an object of the present invention to provide an improved tile coloration.

Therefore, it is an object of the present invention to provide an improved brick coloration.

It is a further object of the present invention to provide an improved brick masonry coloration.

It is a further object of the present invention to provide an improved roof tile coloration.

It is a further object of the present invention to provide an improved clay roof tile coloration.

It is a further object of the present invention to provide an improved concrete roof tile coloration.

It is a further object of the present invention to provide an improved roof tile appearance which simulates antique tile and to provide improved variegated tile color ranges thereon.

It is a further object of the present invention to provide an improved brick appearance which simulates used and antique brick and to provide improved variegated brick color ranges thereon.

It is a further object of the present invention to provide an improved apparatus for applying colorants to clay or concrete items.

It is a further object of the present invention to provide an apparatus for applying colorants to clay or concrete items which can accommodate different types of items such as clay tiles, clay bricks or concrete tiles or blocks.

It is a further object of the present invention to provide an apparatus for applying colorants to clay or concrete items which can accommodate different sizes of said items.

It is a further object of the present invention to provide an apparatus for applying colorants to clay or concrete items which is readily adjustable.

It is a further object of the present invention to provide an apparatus for applying colorants to clay or concrete items which is efficient.

It is a further object of the present invention to provide a method for applying colorants to clay or concrete items which is readily adjustable.

It is a further object of the present invention to provide a method for applying colorants to clay or concrete items which is efficient.

It is a further object of the present invention to provide a method and apparatus for applying colorants to clay or concrete items which provides consistency and repeatability of results, in that it provides items of consistent quality albeit with perceptibly different decorative appearances.

Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

FIG. 9 is a chart showing various modes of operation of the apparatus.

FIGS. 11–15 show twenty-five different two-color patterns used within the spraying technique. It should be understood that these patterns essentially are comprised of two parallel single-color patterns, and either of these single-color patterns could be used in a single color application scheme.

DETAILED DESCRIPTION OF THE PREFERRED EMBODIMENT

General Construction and Operation

Figure 1:
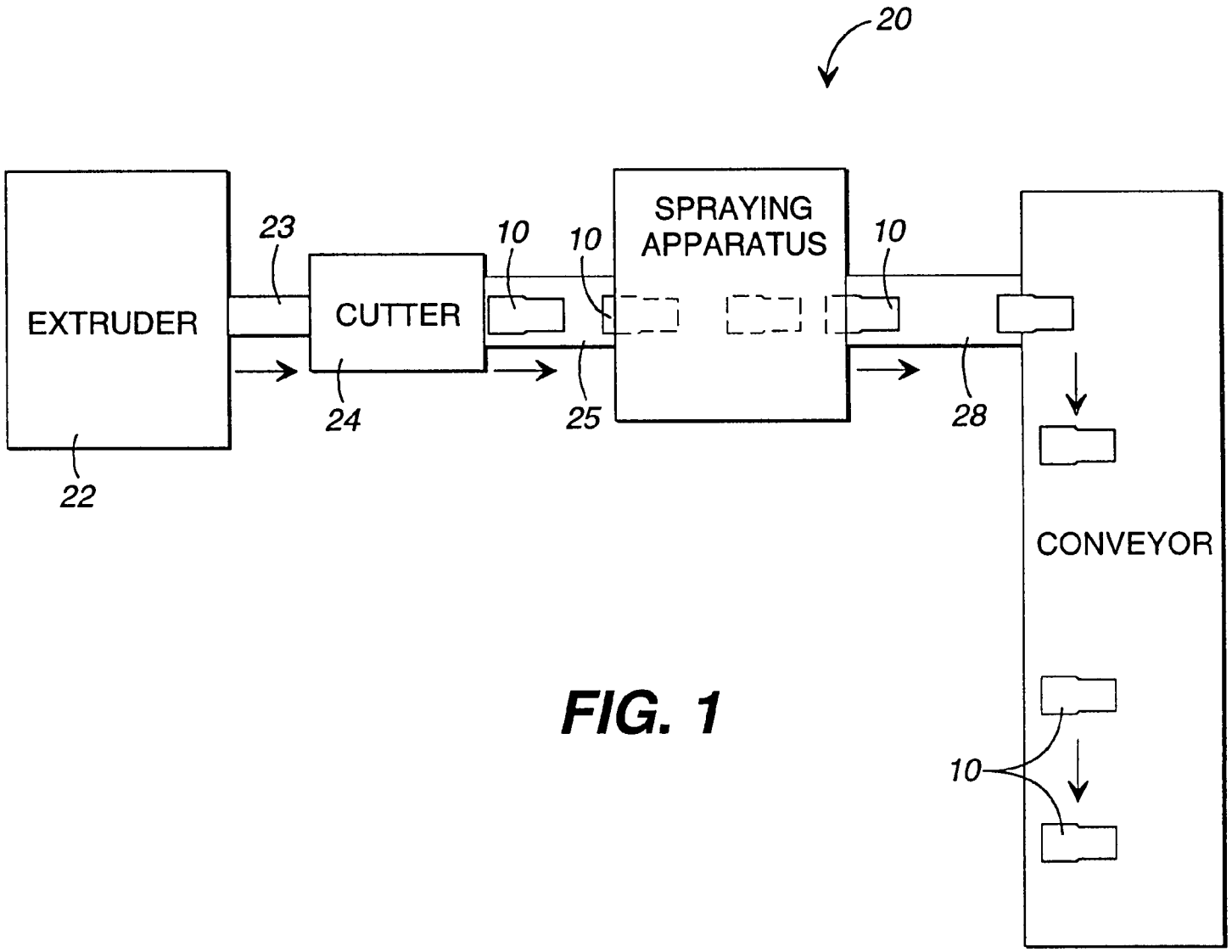
FIG. 1 is a top plan view of an overall system 20 according to the present invention, which includes among other elements a spraying apparatus 30 according to the present invention.
Figure 2:
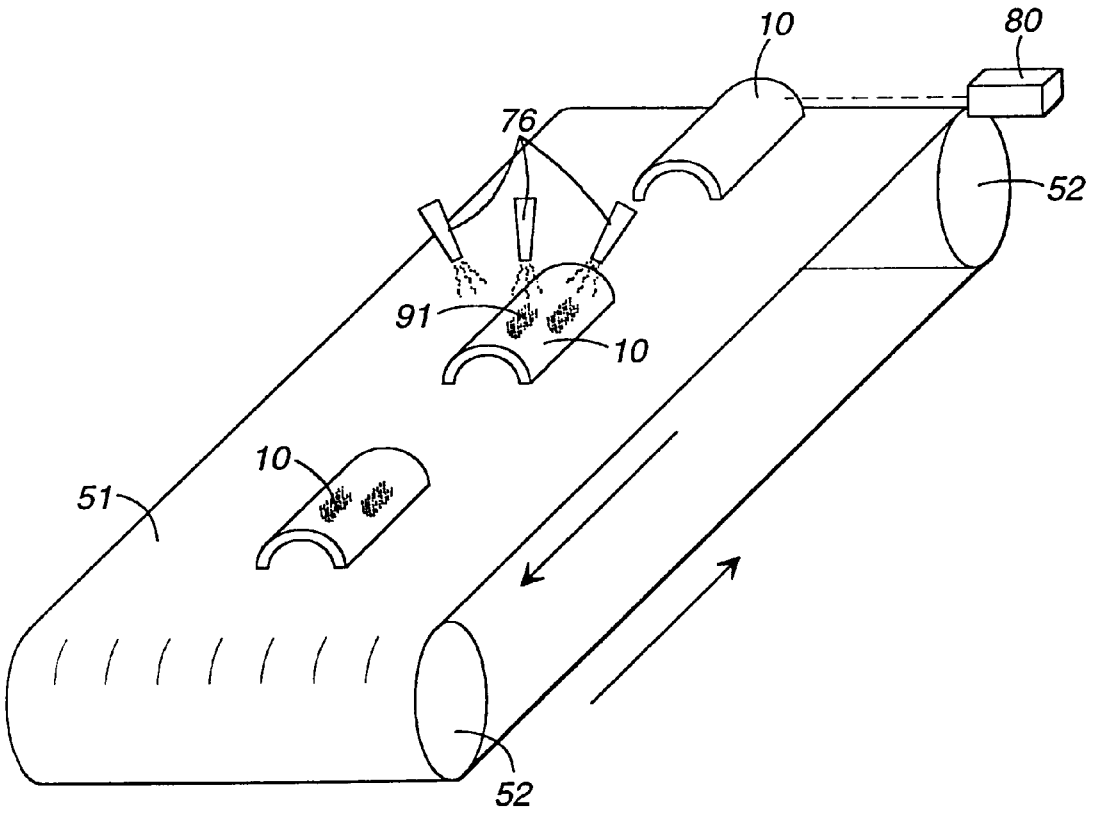
FIG. 2 is a perspective isolated view of a spray conveyor 50 according to the present invention, supporting a plurality of typical tiles 10 placed thereupon. Nozzles generally denoted as 76 are illustrated without their supporting structure, illustrating the spraying of liquid from the nozzles 76 onto the tiles 10.

Generally described, the present invention is directed towards spraying of an item such as a tile 10 such as those shown in FIG. 2, and a method and apparatus for making same. Within an overall system such as shown in FIG. 1, the tiles 10 are formed into a shape such as seen in FIG. 2, and fed to a spraying apparatus 30. One or more aqueous solutions utilized to suspend colorants are applied by the spraying apparatuses 30, in a manner so as to provide random-appearing coloration designs on the tiles after they are later allowed to dry, and in the case of clay product, fired.

Such random-appearing color designs are provided by the use of discretely-sprayed, perceptibly-random spray patterns provided by one or more individual spray nozzle apparatuses mounted upon sidewardly-oscillating carriage assemblies which are configured to oscillate transversely relative to the transport axis of the tiles. This transverse oscillation is independent from the random spraying patterns.

Although a clay tile is described above and below by way of example, the present invention likewise contemplates the treatment of concrete tiles, clay bricks and concrete blocks.

Detailed Discussion

More details regarding the finished tile and the method and apparatus for providing same are now provided, in conjunction with FIGS. 1–15.

The Tile Shapes

Figure 3:
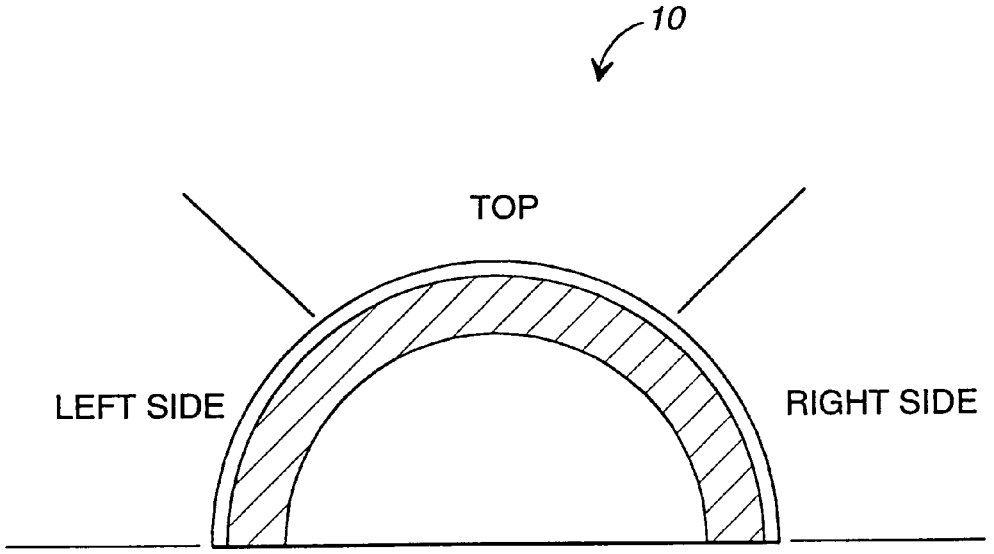
FIG. 3 is a cross-sectional end view of a mission tile 10 used in accordance with the present invention, illustrating different general "sections" of such a tile for reference purposes.
Figure 4:
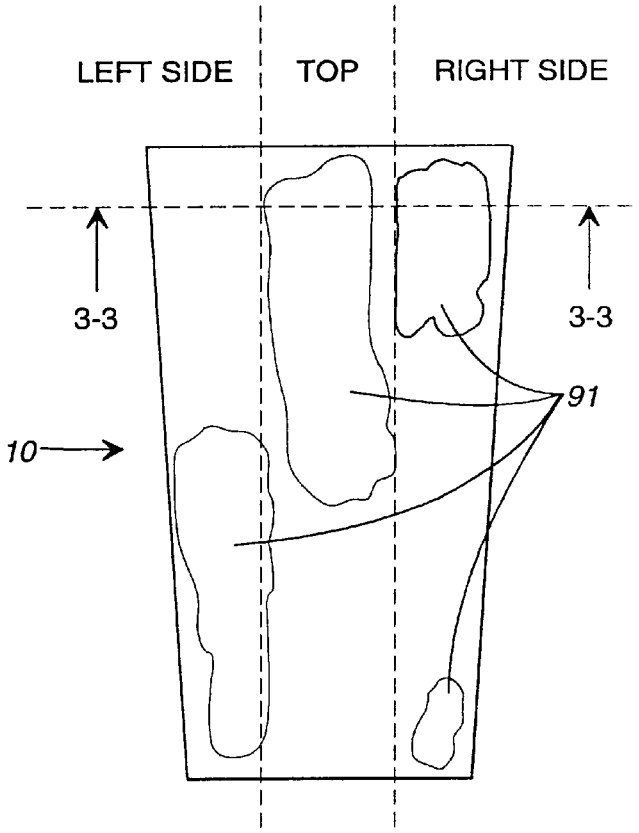
FIG. 4 is a top plan view of a mission tile used according to the present invention, illustrating the sections identified in FIG. 3, as well as illustrating the locations of spray 91 provided upon such a tile 10. As may be seen, two discrete spray locations 91 exist on the right side of the tile shown.
Figure 5:
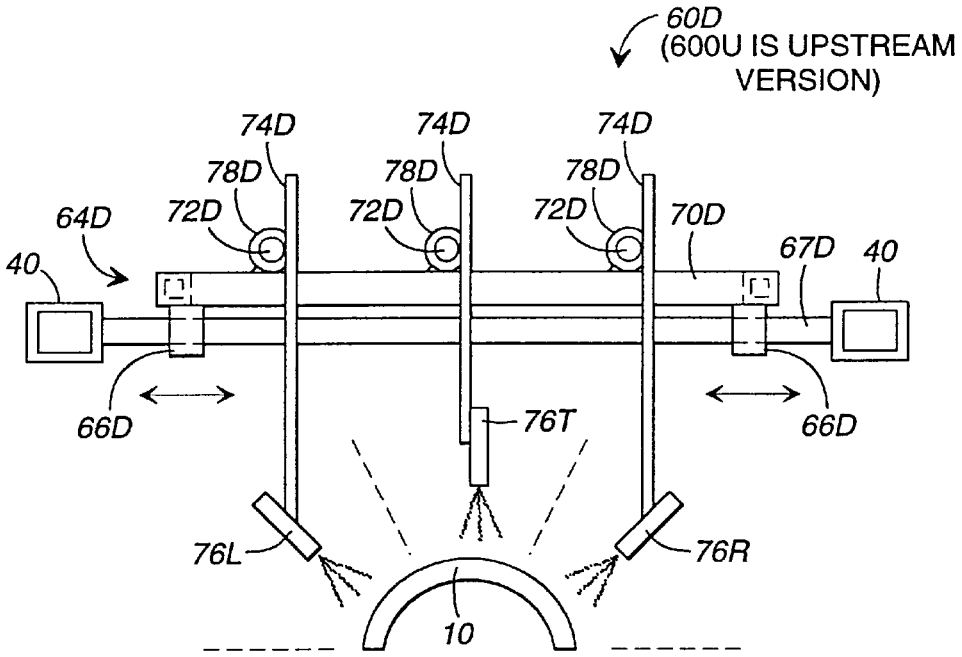
FIG. 5 is a downstream view of an isolated portion of the spraying apparatus according to the present invention, illustrating a spray assembly 60D including a carriage subassembly 64D linearly moveable in a transverse direction relative to the frame 40 of the apparatus.

The tiles 10 shown in FIG. 2, used as an example, are those known commonly as "mission" tiles, although the type of tile is not critical to the practice of some of the present invention. This tile, also shown in FIGS. 3, 4, and 5 is substantially elongate, and includes a substantially "C"-shaped cross-section taken transverse to the longitudinal axis. The longitudinal "long" edges of the tiles 10 are generally parallel, although they taper from their head end to their butt end.

The Overall System

A spraying apparatus 30 according to the present invention, shown at least partially in FIGS. 1, 2, 5, 6, 7, 8 and 10, operates in conjunction with other apparatuses to provide a tile 10 according to the present invention. Operation of the apparatus in conjunction with such other cooperating apparatuses is now discussed in conjunction with FIG. 1.

A continuous ribbon of clay is extruded from an extruder 22 into a clay column 23 having a substantially "C"-shaped cross-section. The clay column 23 is continuously transported to a "traveling cutter" 24, which travels with the continuously-fed clay column and cuts it as known in the art into similar individual tiles 10 having a preselected length. In one configuration according to the present invention, the traveling cutter 24 provides transverse cuts to sever the extruded clay column into tiles 10 having lengths of approximately 19 inches, and also cuts a narrow, tapered sliver portion off each longitudinal side edge of the tile elements, providing the longitudinal side edges with a slightly "tapered" configuration such as known in the art, which allows for desirable stacking of the tiles on inclined roofs.

After being cut, the tiles 10 are then passed by an inlet conveyor 25 as shown in FIG. 1 to the spray conveyor 51 of the spraying apparatus 30 according to the present invention, whereupon they are sprayed as described later in this application. The spray conveyor 51 is in the preferred embodiment a chain conveyor. Upon exiting the spraying apparatus 30, the tiles 10 are then transferred to one or more exit conveyors 28 or other suitable means, to be marshaled and grouped for drying, such as known in the art.

As noted above, the spraying apparatus according to the present invention operates in conjunction with other apparatuses to provide a tile according to the present invention. These other apparatuses can be such as those known in the art.

The Spraying Apparatus Generally

Referring now generally to the figures, a spraying apparatus 30 according to the present invention includes a frame 40, a spray conveyor 51, upstream and downstream spray assemblies 60U, 60D, respectively a tile presence sensor 80, and an aqueous coating supply system generally designated as 90.

Referring now particularly to FIG. 5, the frame 40 of the spraying apparatus 30 is substantially rigid in construction and is substantially stationary when used. The frame 40 is made of various conventional structural materials such as structural tubing. The frame 40 serves to provide structural support for various of the elements discussed below, including the spray conveyor 51 such as shown in FIG. 2, the upstream and downstream spray assemblies 60U, 60D the tile presence sensor 80 shown in FIG. 2 (attached relative to the conveyor frame), and a portion of the aqueous coating fluid supply system 90.

The spray apparatus 30 if desired may include various shielding configurations and ventilation configurations (not shown) such as known in the prior art to reduce spray admissions outwardly therefrom. The spray apparatus 30 can be enclosed on three sides with thin sheet metal except for openings to allow tiles to enter and exit at each ends. Two pneumatic cylinders can be used to retract to provide enclosure of the fourth side and top hood. An 18" diameter exhaust opening can be located on the center of the top hood of the machine to extract airborne aqueous solution which is deflected from tile or various components of the machine. The exhaust is evacuated by a axial fan (½ H.P.; 1840 RPM). Air exhausted from the spray machine is discharged in a aqueous solution in a 4 ft. long×6 ft. wide×2 ft. high rectangular collection pan which can be moved in and out underneath the tile chain conveyor with a forklift. There are two 2 inch O.D. drain lines on this collection pan to facilitate removal of the collection solution as necessary. The above numbers are only exemplary; other dimensions and specifications could likewise be used without departing from the spirit and scope of the present invention.

The Spray Conveyor

Referring now particularly to FIG. 2, the spray conveyor 51 is a "chain" conveyor, in that it is composed of a chain-like structure allowing aqueous solution to pass therethrough. This allows for a spray fluid recycling configuration when appropriate, in that fluid which does not adhere to the tiles 10 can pass through the belt and drop under the influence of gravity into a recycling tank (not shown) positioned below the endless chain conveyor.

The speed of the conveyor is preferably set to a constant speed during normal operation. Using a 19 inch mission tile setup as an example, this speed can be set to process approximately thirty (30) tiles per minute, with approximately one tile length of spacing between the tiles. However, other speeds can be used without departing from the spirit and scope of the present invention.

The controls for the conveyor are linked to the controls of the downstream conveyors.

The Spray Assemblies

Figure 6:
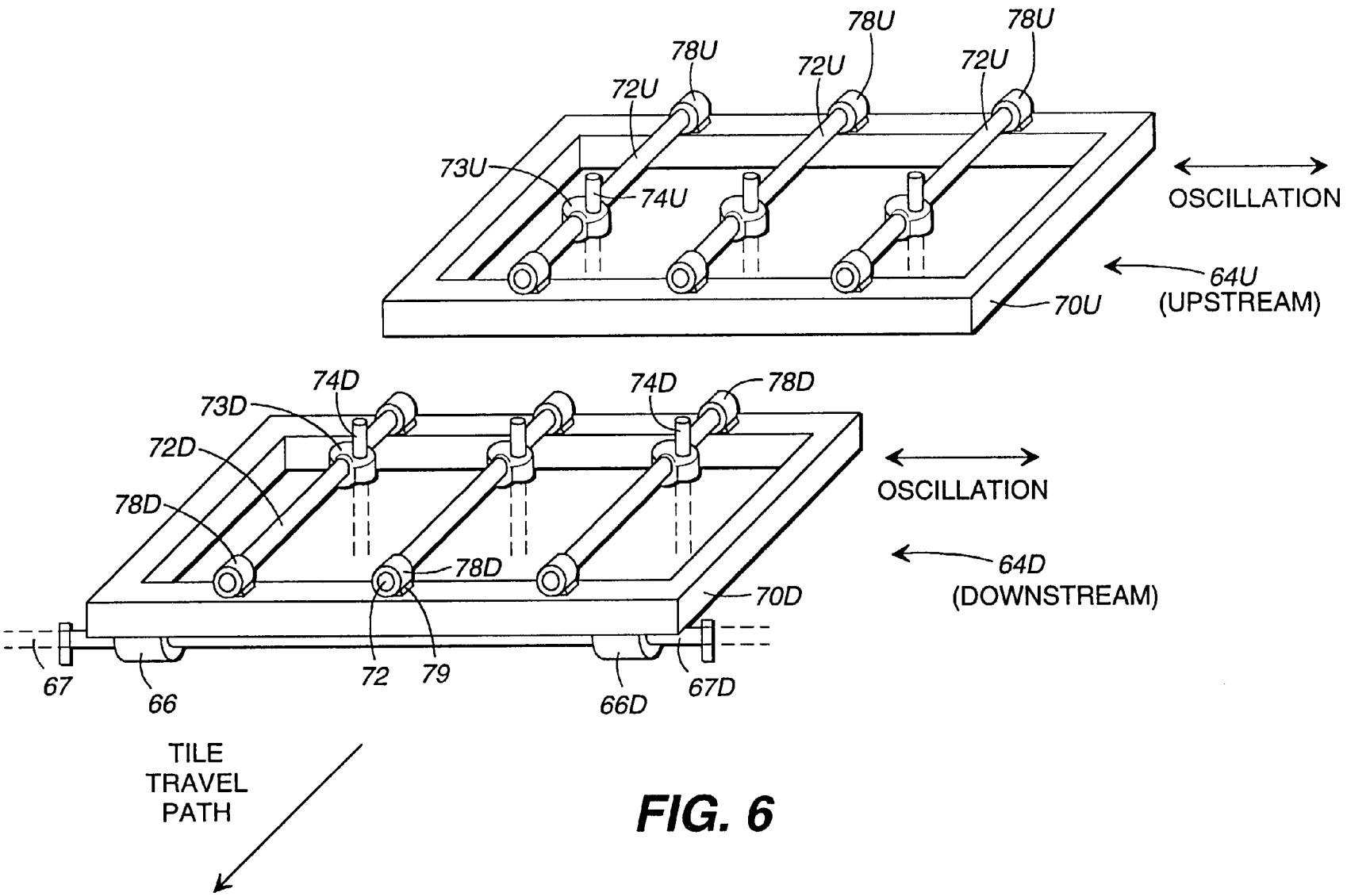
FIG. 6 is an isolated perspective view of carriage assemblies according to the present invention, namely an upstream carriage subassembly 64U, and the downstream carriage subassembly 64D of FIG. 5.

Referring now particularly to FIG. 6, positioned generally above the spray conveyor are two spray assemblies, an upstream spray assembly 60U and a downstream spray assembly 60D. These spray assemblies 60U, 60D are similar to each other in design and operation, the main differences being that the upstream spray assembly 60U is further upstream along the tile transfer path than is the downstream spray assembly 60D, and the two different assemblies 60U, 60D can be used to spray different aqueous coating solutions corresponding to different finished tile color highlights. As noted below, the two assemblies spray at different times in order to provide in many cases overlaid patterns atop individual tiles.

As the spray assemblies 60U, 60D are similar in construction, referring now also to FIG. 5, an exemplary spray assembly 60D will be used as an example. The spray assembly 60D includes a corresponding carriage subassembly 64D, four linear slide bearings 66D (only two are shown in FIG. 5), and a corresponding oscillating means (not shown).

The four linear slide bearings 66D are rigidly attached to the underneath of the substantially rectangular carriage subassembly 64D at its four corners. For each subassembly, such as subassembly 64D, there are two transversely-mounted carriage support rods such as 67D (only one is shown) which are rigidly attached relative to the frame 46 of the apparatus 30 and which pass above and across the path of the conveyor. These two ¾ "diameter carriage support rods 67D each accept a pair of the ¾ "linear slide bearings 66D, such that the carriage subassembly 64D can slide back and forth along an axis substantially parallel to the longitudinal axes of the carriage support rods 67D. By the use of an oscillating means, which in the preferred embodiment is a double-acting 2" stroke pneumatic cylinder, the carriage subassembly 64D can oscillate back and forth relative to the path of the tiles passing therebelow. The speed of the oscillation can be adjusted by adjusting the airflow through the cylinder.

As shown best in FIGS. 5 and 6, the carriage subassembly 64D includes a rectangular frame 70, three horizontal nozzle supporting rods 72D, three vertical supporting rods 74D and three spray nozzles 76L, 76T, 76R. The 1" horizontal nozzle supporting rods 72D are mounted to the top of the rectangular frame 70D of the carriage subassembly 64D by the use of six collars 78D (two for each rod 72D) rigidly affixed to the carriage. An adjustable set screw connection is provided between the rods 72D and the collars 78D to allow for nozzle position adjustment as described below. In the preferred embodiment, the horizontal nozzle support rods 72D are mounted such that their longitudinal axes are substantially parallel to the travel axis of the tiles upon the spray conveyor 50. The rectangular frame 70D of the carriage subassembly 64D is constructed of 1" square tubing.

Continuing to refer primarily to FIGS. 5 and 6, attached to each of the three horizontal nozzle supporting rods 72D is a corresponding vertical nozzle supporting rod 74D, each having its upper end attached to a medial portion of a horizontal nozzle supporting rod. Corresponding adjustable clamps 73D provide the connections between the supporting rods 72D and the vertical nozzle supporting rods 74D. The lower end of each vertical nozzle supporting rod 74D is attached to and supports a corresponding spray nozzle, as shown in FIG. 5. As may be seen, in the embodiment shown three spray nozzles are used within each carriage subassembly, although other configurations may be used without departing from the spirit and scope of the present invention. As shown in FIG. 5, a downstream, left spray nozzle 76L is used to spray the left sides of the tiles, a downstream, top spray nozzle 76T is used to spray the tops of the tiles, and a downstream, right spray nozzle 76R is used to spray the right sides of the tiles. In the preferred embodiment, the spray nozzle tips are approximately eight (8) inches from the tile surfaces when spraying.

It may be understood that the nozzles are substantially rigidly attached relative to the carriages during operation, but their positions can be relatively adjusted thereto. Therefore it should be appreciated that as the carriages oscillate, so do the nozzles. However, it should also be understood that the rods 72D may be rotated somewhat (by loosening and tightening the set screws) to allow adjustment as desired of the spray nozzles about the longitudinal axis of the spray support rods.

The spray nozzles are adjustable from a tight fan to a wide fan configuration, as in the preferred embodiment used the mission tiles are not conically sprayed. In the embodiment shown in FIG. 5, the spray fan is perpendicular to the travel of the tiles.

The upstream spray assembly 60U and the downstream spray assembly 60D oscillate independently of each other, and oscillate independently of the spraying processes described elsewhere. This provides a perceptibly "random" appearance to the tiles, in that straight lines are not provided across the tiles. In one preferred embodiment, the stroke is approximately 2 inches for a tile width of approximately 7 inches.

In one preferred embodiment, the frequency of movement of the carriages is such that there is less than one sideward cycle of the carriages per each tile or other item passing therebelow. This is because it has been found desirable to prevent the perception of a "zig-zag" or even diagonal pattern on the items being sprayed, while still providing some random placement of the fluid on the tiles. As an example only, the period (i.e., the time for one back-and-forth stroke) for each transverse cycle of the carriages can be approximately five (5) seconds.

Tile Presence Sensor

As shown in FIG. 2, a tile presence sensor is provided with its beam crossing the path of the tiles at the lead end of the conveyor 50, such that detection is provided of tiles which enter the spraying apparatus 30 atop the conveyor. As discussed elsewhere in this application, this provides a tile presence signal to a programmable logic controller. By the use of appropriate delay times, and based upon known or presumed conveyor speeds, this allows the programmable logic controller to anticipate where the tile is on the conveyor to facilitate spraying at the appropriate time.

Fluid Supply to the Nozzles

Figure 7:
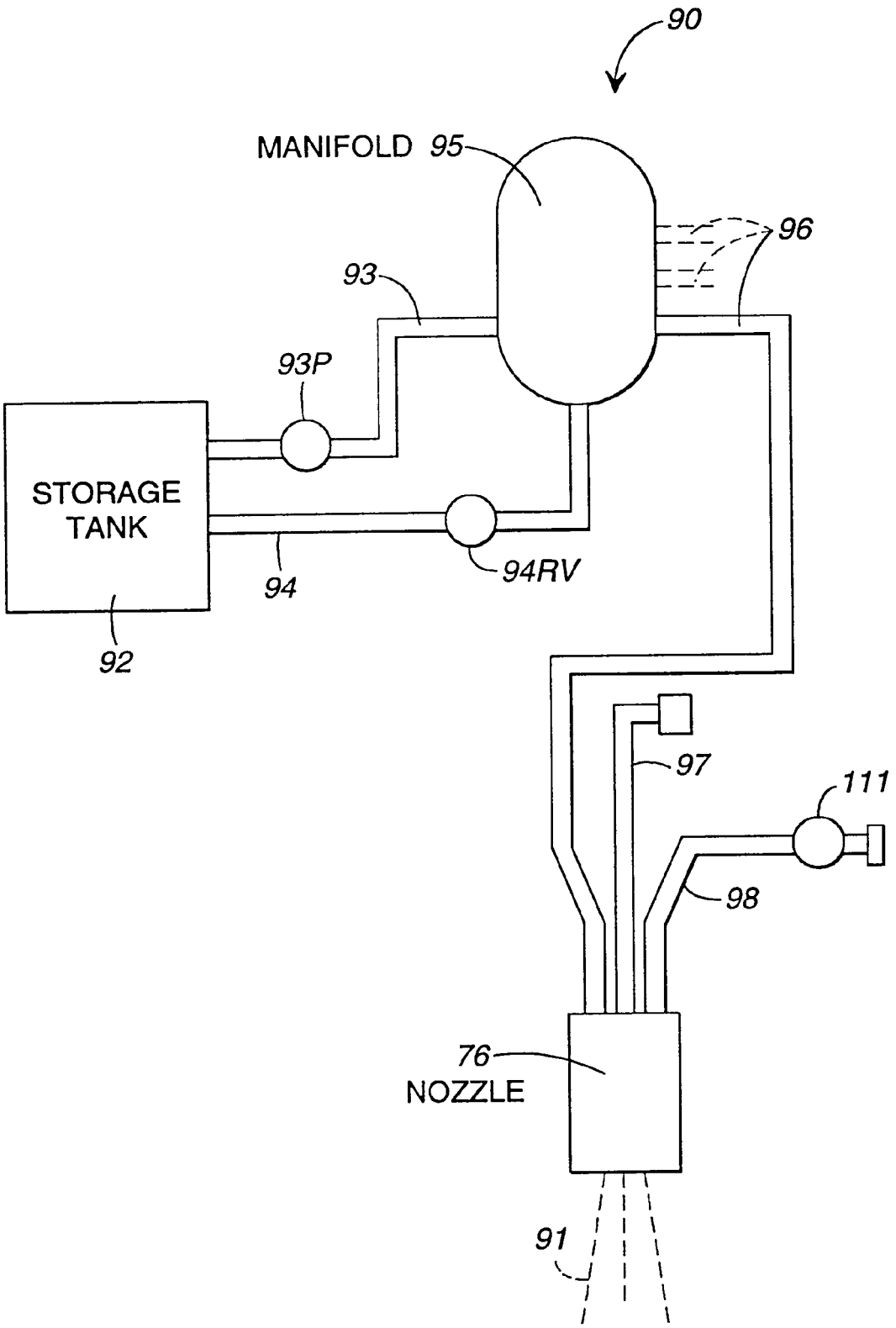
FIG. 7 is a diagram of a fluid supply system 90, which combines to provide a spray of liquid 91 from nozzles 76 as desired.

In the preferred embodiment shown, which uses more than one type of fluid spray, a separate fluid supply system is used for each fluid. FIG. 7 shows one fluid supply system 90 which supplies fluid to be sprayed as 91 from a typical spray nozzle 76. Three nozzles are associated with each spray system.

After being mixed, fluid such as engobe is transferred through a sieve into a main storage tank 92, which in the preferred embodiment is a 55 gallon drum, although other storage means can obviously be used.

The main storage tank 92 in one embodiment has a Binks top lid which incorporates an agitator shaft with two stainless steel mixing blades. The agitator shaft is powered by a Binks air motor. The main storage tank supplies fluid to a fluid manifold 95 through a manifold supply line 93 having a fluid pump 93 P therein (in one embodiment a Binks diaphragm pump). The manifold supply line includes a mesh strainer therein. The manifold is a cylindrical manifold approximately 4" in diameter and 13" long, although other configurations could be used without departing from the spirit and scope of the present invention.

To prevent fluid from settling in the transmission lines or the manifold, there is a return line 94 having a pressure relief valve 94RV therein. The purpose of the valve 94RV is to induce back pressure in the system which inhibits settling of the fluid as it is returned to the tank. A substantially constant pressure is maintained within the manifold 95 by use of a return line 94 having a pressure relief valve 94RV therein. A separate fluid supply line 96 is configured to supply fluid from the manifold 95 to each of the three associated spray nozzles 76.

As shown in FIG. 7, three supply lines merge into each spray nozzle 76, the previously-discussed fluid supply line 96, as well as an atomizing air line 97 and a solenoid line 98. The atomizing air line 97 is configured to supply air sufficient to atomize the fluid supplied by the fluid supply line 96 into a sprayable form. The solenoid line 98 is in the preferred embodiment an air line which operates a valve within the nozzle 76 to release the fluid and the atomizing air, and is itself controlled by upstream solenoids 111 also referenced in FIG. 8.

Figure 8:
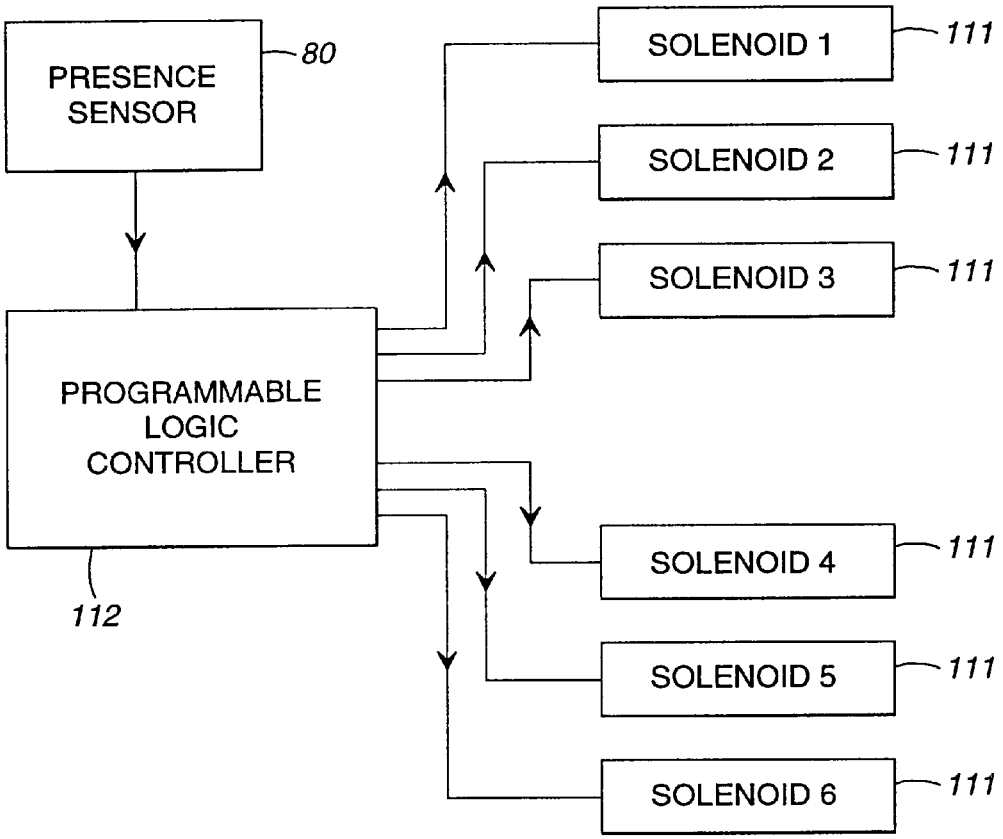
FIG. 8 is a diagram illustrating the interaction of a programmable logic controller with solenoids 1–6.

Reference is now also made to FIG. 8, which illustrates the interaction of the solenoids 111, which are controlled by the programmable logic controller (PLC) 112. As will be discussed in detail elsewhere in this application, the PLC 112 can be programmed to issue signals to the solenoids 111 to provide different preset spray patterns to the associated spray nozzles 76.

A different preset spray pattern can correspond to each tile. The nozzles can cycle "on" and "off" differently for each pattern. Sometimes only one nozzle will "fire"; sometimes all three nozzles will fire. For one tile, one side of the tile may be completely sprayed, with the other side being only partially sprayed, and the top being either fully or partially or not sprayed at all. It is also possible to have a spray nozzle spray two discrete portions on single tile, as shown in FIG. 4.

As depicted in FIG. 7, the fluid supply line 96 is at approximately 30–35 psi, the atomizing air supply line 97 is typically at approximately 70–75 psi, and the solenoid line is typically at 30–35 psi.

Controls Box Setup

Figure 10:
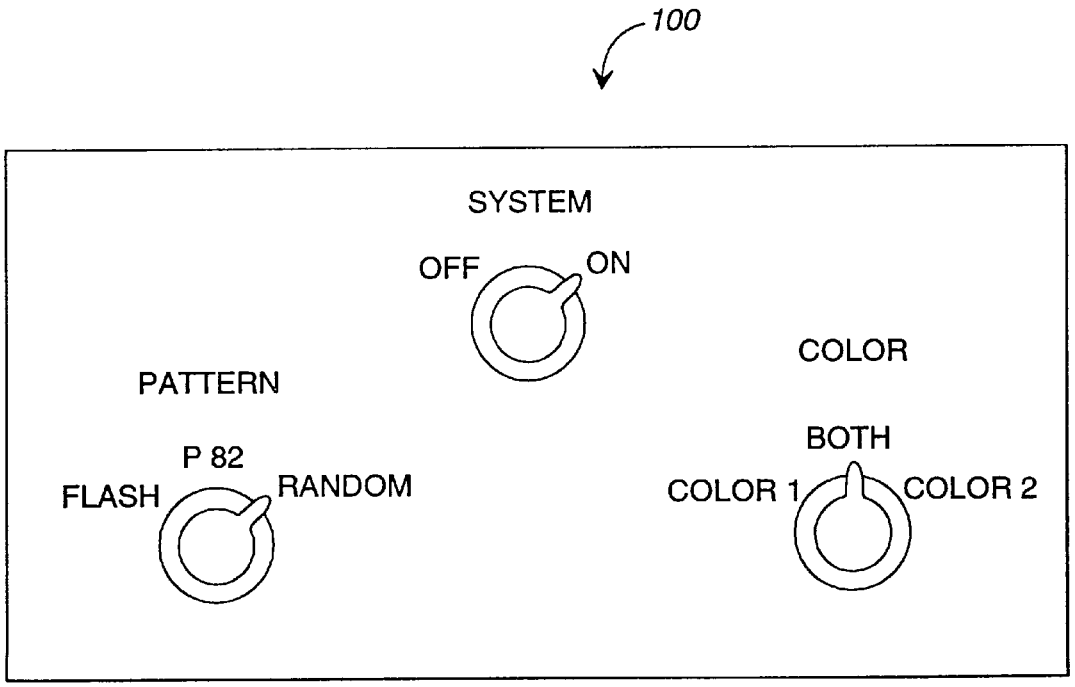
FIG. 10 is a simplified view of controls used in conjunction with the spraying apparatus 30 according to the present invention.

Reference is now made to FIG. 10, which shows an exemplary control box setup. The controls include three knobs, the first being a "SYSTEM" control knob, having "OFF", and "ON" settings. The second is a "PATTERN" control knob, having three settings, "FLASH", "P82", and "RANDOM". The last knob is a "COLOR" control knob, having three settings, "COLOR1", "BOTH", and "COLOR 2".

The "ON" and "OFF controls are fairly selfexplanatory.

With respect to the COLOR control, under the "COLOR 1" setting, one color is sprayed. Under the "COLOR 2" setting, a second color is sprayed. Under the "BOTH" setting, assuming other conditions are met, both colors are sprayed.

Although discussed in detail later, with respect to the "PATTERN" settings, the "FLASH" setting provides a straight strip right down the middle of the tile which provides a coloration which simulates a flashing condition during the firing of clay products. Under this setting only the center spray nozzles spray the length of the tile, and no oscillation occurs. The "P82" setting is a setting in which 60% of the tiles are "flashed", and 40% are not. Again, no oscillation occurs. The "RANDOM" setting is the one that provides the random-appearing patterns discussed later. Only under this setting does oscillation of the carriages occur.

Various Modes of Operation

Reference is now made to FIG. 9, which is a chart illustrating various modes of operation of the apparatus.

There are three program options which are utilized to spray aqueous solutions or engobe coatings onto roofing tiles which can be generally described as follows:

Flash:

(a) if color 1 is selected, the center gun only from spray bank #1 sprays the entire length of each tile.

(b) if color 2 is selected, the center guns only from spray bank #2 spray the entire length of each tile.

(c) only one engobe color is used in this mode.

(d) oscillation feature is off.

P82:

(a) if color #1 is selected the center gun only from bank 1 coats the entire length of 6 consecutive tiles, then skips 4 complete tiles.

(b) if color #2 is selected the center gun only from bank 2 coats 6 consecutive tiles, then skips 4 complete tiles.

(c) oscillation feature is off.

Random:

(a) if color #1 is selected, bank 1 guns spray tiles with 25 single color patterns.

(b) if color #2 is selected, bank 2 guns spray tiles with 25 single color patterns.

(c) if both color #1 and color #2 are selected, both banks are used to spray tiles with 50 two color patterns.

(d) oscillation feature for both banks is on.

(e) color patterns are predefined and repeat every 50 tiles.

(f) each tile is gridded into 45 grids (3×15)

(g) the oscillation feature is not synchronized with each predefined color pattern, thereby increasing the random effect of the spray colors.

Computer Control

As noted above, one of the settings of the "PATTERN" control knob in FIG. 10 is a "RANDOM" setting. This is a significant feature of the present invention which provides perceptively random spray patterns. This is accomplished in one preferred embodiment by the use of multiple spraying elements which are controlled at a substantially central source, in this case by a programmable logic controller (PLC). In essence, the PLC provides a repeating series of different preset spray patterns which are discussed in detail later. These preset patterns, when used in conjunction with the sideward oscillation discussed above, provide the perceptively random spray patterns provided by the present invention.

As noted above, a PLC running a computer program controls the spray guns. The program assumes that the tile passes through the spray booth at a relatively consistent speed once it is detected by the photo sensor at the entrance of the booth. The program relies on a very compact, fast code with indirect addressing to be able to turn the spray guns on and off to target the predetermined areas on the tile.

To implement the program, an Excel® spread sheet was utilized to plan the spray patterns desired into the three 3 sectioned areas (left, center, right) from head to butt and 15 slices across tile gridded areas on the tile are defined. This sectioning results in 45 grid areas on the tile. Once the desired grids which are to be sprayed with engobe are defined, this information is then programmed. When two colors are utilized, each color can be programmed to be applied to specific grids desired or both colors can be applied to identical grids or a combination of both. Each carriage can also be programmed to oscillate when desired to provide more random appearing engobe applications. The result is the capability to apply engobe sprays which appear to be random in consistent and repeatable patterns.

The Perceptively Random Spray Patterns

As discussed in detail later, under one embodiment of the present invention, there are 25 different spray patterns, configured to provide different patterns to the tiles, although more or less patterns may be used without departing from spirit and scope of the present invention.

In order to explain the concept of the preset spray patterns, FIG. 14 will be used as an example, in particular the Pattern 20 shown therein. As may be seen, Pattern 20 includes fifteen (15) rows and six (6) columns. The fifteen rows correspond to fifteen length segments of equal length into which the tiles are divided. As noted above, the tiles when sprayed are approximately 17 inches long; therefore each of the fifteen tiles lengths are slightly more than one inch in length. The six columns correspond to the six spray nozzles used as described above, with three spray nozzles (a "left", "top", and a "right" nozzle) being used for each of the two colors "Color 1" and "Color 2".

Pattern 20 is explained in more detail. The arrow points towards the "lead" edge of the pattern, which corresponds to the lead edge of the tile as it passes under the spray nozzles. Assuming calibration is correct, all three of the Color 1 spray nozzles will begin spraying when the leading edge of the tile passes thereunder. When the tile has passed 6/15 of its length past the spray nozzles, the Color 1 top nozzle will stop firing. The other two Color 1 spray nozzles will continue spraying until the tile is completely past, whereupon they will cease firing. However, the top Color 1 nozzle will resume spraying for the last three of the fifteen length segments passing under the spray nozzles.

With respect to the spraying of Color 2 in Pattern 20, the "left" and "right" nozzles will begin spraying upon encountering the lead edge of the tile. Assuming that the Color 1 nozzles are upstream of the Color 2 nozzles, this will result in Color 2 fluid being sprayed over Color 1 fluid. After the first 5/15 of the tile has been sprayed, both spray nozzles will stop spraying. The "top" spray nozzle for Color 2 will never spray within this pattern.

Operation

To operate the apparatus, it is typically turned on by selecting the "ON" position for the "SYSTEM" switch shown in FIG. 10, after the desired settings are selected for the "PATTERN" and "COLOR" settings. After a tile is sensed by the presence sensor 80, spraying commences a present time later, which preferably corresponds to the time the lead edge of the tile passes beneath the relevant spray heads.

If only one set of spray guns are being used, only one delay will be used. However, if two sets of spray guns are being used, the most downstream set of guns will be associated with a longer delay time, for obvious reasons. These delay times can be adjusted for different belt speeds.

If the sensor does not sense a tile for over 10 seconds, the oscillator is stopped.

The Fluids Used

It should be understood that various paints, colorants, slurries engobes, or reactive solutions can be used as the aqueous coating fluid described above. Typically, for clay applications, engobe, glaze, or other ceramic coating colorants or chemicals may be used. In the Instance of concrete, conventional concrete colorants can be used.

Materials and Specifications

Although other elements may be used without departing from the spirit and scope of the present invention, the following elements may be used within the apparatus according to the present invention.

Elements which can be manufactured by Binks include the following:

| | |
|---|---|
| Axial fan, ½HP, 1840 RPM | Model No. 30-1803 |
| Agitator drive/cover assy | Model No. 41-2705 |
| Back pressure regulator | Model No. 84-530 |
| Diaphragm Pump | Model No. 135-100 |
| Spray Nozzles (6 used) | Model No. 610V |
| Spray Gun mounting brackets | Model No. 54-380 |

Elements which can be manufactured by McMaster Carr Inc., Los Angeles, Calif.), include the following:

Space Mizer 2" stroke air cylinders, 2 req'd, Model No. 6212K34;

Thompson Linear Bearings, 8 req'd,

Model No. 6255K35;

Air filter regulator, 2 req'd, ⅜" port,

Model No. 4910K92.

Elements which can be manufactured by Miller Fluid Power include the following:

Solenoid valve (for spray guns), 6 req'd,

Model No. 315-325-15NC;

Solenoid valve (for oscillating cylinders), 2 req'd,

Model No. 315-525-15

Manifold (for solenoid valves), 1 req'd,

Model No. 315-MK025×8;

Flow control (for oscillating cylinders), 4 req'd, Model No. 340-FLO-2.

With respect to computer hardware, under an example system, the computer program can be installed as a subroutine on an existing Allen Bradley PLC 5 with adequate spare memory available. For other manufacturing locations considering this machine the application could be incorporated on a more economical processor platform. An Allen Bradley SLC 503 or SLC 501 platform could also be used, after being set by one skilled in the art.

Clay Tile Alternatives

As noted above, the present invention is not limited to the use of clay "mission" tiles. Other tiles can also be used according to the spirit and scope of the present invention, such as "S" tiles, or "twin S" tiles. The spray techniques can be similar, although some re-aiming of the guns may be required.

Flat Tile Alternative

As noted above, other tile configurations may be used under the present invention. For example, flat concrete or clay roof tile could be used, and sprayed with a random wood grain configuration. A more narrow, discrete spray be used to provide the desired wood grain pattern.

Brick Alternatives/Other Applications

While the program is custom designed to detect and coat individual (separate) tiles, it could, with modification be applicable to other products. For example, flat tiles could be treated.

It should also be understood that concrete and clay bricks could also be used under the spirit and scope of the present invention.

As is known in the art, when clay bricks are manufactured, typically a continuous ribbon of clay is extruded which is textured and subjected to various liquid, slurry engobe, powder, sand or other coating materials, then sectioned into slugs which can be cut into individual bricks, or the continuously extruded column is cut into individual bricks without first being cut into slugs.

The program could therefore be modified to repeat on a continuous column of product such as an extruded clay column for production of bricks or a continuous train of concrete tiles on molds. Such modification would allow for creation of other types of patterns. The possibilities of programming this system provide for an almost endless number of color patterns, when used with engobes or other appropriate fluids.

In the manufacture of molded or soft mud brick, clay of soft consistency is pressed into cavities created from wooden molds or a metallic guided chain to form brick. Once formed, these "soft mud" bricks are removed from their molds and placed upon pallets and dried. After drying, the bricks are removed from pallets and marshaled to a setting.

The spraying apparatus described above could be used at various points along this manufacturing process, such as after bricks are removed from their molds or during the marshaling process.

Conclusion

While this invention has been described in specific detail with reference to the disclosed embodiments, it will be understood that many variations and modifications may be effected within the spirit and scope of the invention as described in the appended claims.

What is claimed is:

1. An spraying apparatus for providing random spray patterns on elongate mission-style tiles each having a longitudinal axis, a "C"-shaped transverse cross section and an outer curved surface, said apparatus comprising:

a conveying device for conveying said mission-style tiles along a conveying path such that their longitudinal axes are substantially parallel to said conveying path and their curved surfaces are generally directed upwardly but also have surface portions at different heights relative to said conveying path and at different orientations;

a spraying device including first and second spray nozzles for providing different spray patterns onto said tiles or other similar items by direct spraying as they are conveyed along said conveying path, both of said spray nozzles having separate and discrete on and off spraying capabilities and said first spray nozzle positioned at a height and orientation different from that of said second spray nozzle; and an oscillation device for moving said spraying device including both of said spray nozzles laterally and simultaneously relative to said conveying path such that said spray nozzles vary in distance from the spray-receiving surfaces, such that said transverse oscillation, combined with said provision of said separate and discrete spray patterns, and said different heights and orientations of said first and second spray nozzles, combine to provide a perceptively random application of said fluid to said mission tiles.

2. The spraying apparatus as claimed in claim 1, wherein both of said oscillation devices are provided by the supply of pressurized air.

3. The spraying apparatus as claimed in claim 1, wherein said direct spraying is provided by multiple spray guns during which spray at different times relative to each other.

4. The spraying apparatus for providing perceptively random spray patterns on elongate mission-style tiles as claimed in claim 1, wherein said spraying step is provided by the use of multiple sprayers spraying one tile at a time.

5. The spraying apparatus for providing perceptively random spray patterns on elongate mission-style tiles as claimed in claim 1, wherein said spraying step is provided by the use of multiple sprayers spraying multiple tiles or other similar items at the same time.

6. The apparatus for providing perceptively random spray patterns on elongate mission-style tiles as claimed in claim 1, wherein said multiple sprayers are controlled by a programmable logic controller spraying onto predefined segments defined onto the tiles.

7. An apparatus for providing spray patterns on elongate mission-style tiles, said apparatus comprising:

conveying means for conveying said tiles along a conveying path such that each of said mission-style tiles have exterior surface portions being at differing heights and orientations;

a first spraying device including at least one spray nozzle for providing different discrete on and off spray patterns directly onto said tiles or other similar items as they are conveyed along said conveying path, said first spraying nozzle being at a first height and a first orientation;

a first transverse oscillation device for moving said spraying means including at least one spray nozzle laterally relative to said conveying path, a second spraying device including at least one spray nozzle for providing different discrete on and off spray patterns directly onto said tiles or other similar items as they are conveyed along said conveying path, said second spraying nozzle being at a second height and a second orientation, said second height being different from said first height and said second orientation being different from said first orientation; and a second transverse oscillation device for moving said spraying means including at least one spray nozzle laterally relative to said conveying path, such that said transverse oscillation, combined with said provision of said separate and discrete spray patterns, and said different heights and orientations of said first and second spray nozzles which cause their spraying to be done at varying distances relative to the spray receiving surface, combine to provide a perceptively random application of said fluid to said tiles or other similar items.

8. The apparatus for providing perceptively random spray patterns on elongate mission-style tiles as claimed in claim 7, wherein said first and second oscillation devices oscillate independently.

9. The apparatus for providing perceptively random spray patterns on elongate mission-style tiles as claimed in claim 7, wherein said first and second oscillation devices are provided by the supply of pressurized air.

10. The apparatus for providing perceptively random spray patterns on elongate mission-style tiles as claimed in claim 7, wherein said elongate mission-style tiles pass under said first and second spraying devices one at a time.

11. The apparatus for providing perceptively random spray patterns on elongate mission-style tiles as claimed in claim 7, wherein said multiple sprayers are controlled by a programmable logic controller.

12. An apparatus for providing perceptively random spray patterns on elongate mission-style tiles each having exterior surface portions having different orientations, said apparatus comprising:

a frame;

a conveyor for conveying said tiles or other similar items along a conveying path having a transverse width;

a plurality of spraying devices for directly spraying said elongate mission-style tiles while on said conveying path, said plurality of spraying devices being located at different heights and orientations relative to said conveying path;

a carriage for supporting said plurality of spraying devices such that said spraying devices are above said conveying path; and an oscillating device configured to move said carriage in an oscillating manner along a path having a component transverse to said conveying axis, such that said oscillating device causes said carriage to oscillate sidewardly during said spraying process, causing spray to be sprayed at different locations along the width of said conveying path by said plurality of spraying devices and likewise causing said spray to be sprayed from varying distances relative to the spray receiving surfaces.

13. An apparatus for providing perceptively random spray patterns on elongate mission-style tiles as claimed in claim 12, wherein said plurality of spraying devices includes a plurality of spray guns having different spray orientations.

14. An apparatus for providing perceptively random spray patterns on elongate mission-style tiles as claimed in claim 13, wherein said plurality of spray guns comprises at least three in number.

15. An apparatus for providing perceptively random spray patterns on elongate mission-style tiles as claimed in claim 12, wherein said oscillation device is provided by the supply of pressurized air.

16. An apparatus for providing perceptively random spray patterns on elongate mission-style tiles as claimed in claim 12, wherein said carriage includes adjustable mounts for providing adjustment of said spraying device relative to said conveying path.

17. An apparatus for providing perceptively random spray patterns on elongate mission-style tiles as claimed in claim 16, wherein said carriage itself further comprises:

a peripheral frame;

at least one bar extending generally in the direction of conveying;

a spray head mounting bar;

a spray head; and an adjustment block, said adjustment block configured to allow said adjustment of said spray head vertically relative to said conveying path.

18. An apparatus for providing perceptively random spray patterns on elongate mission-style tiles as claimed in claim 17, wherein said adjustment block is also configured to allow said adjustment of said spray head laterally relative to said conveying path.

19. An apparatus for providing perceptively random spray patterns on elongate mission-style tiles each having exterior surface portions having different orientations, said apparatus comprising:

a frame;

a conveyor for conveying said elongate mission-style tiles along a conveying path having a transverse width;

multiple spraying devices for directly spraying said tiles or other similar items while on said conveying path, said multiple spraying devices being located at different heights and orientations relative to said conveying path;

a carriage for supporting said multiple spraying devices such that said spraying devices are above said conveying path; and an oscillating device configured to move said carriage in an oscillating manner along a path having a component transverse to said conveying axis, such that said oscillating device causes said carriage to oscillate sidewardly during said spraying process, causing spray to be sprayed at different locations along the width of said conveying path and from varying distances relative to the spray receiving surfaces.

20. The apparatus for providing perceptively random spray patterns on elongate mission-style tiles as claimed in claim 19, wherein said spraying head are at least three in number and are configured in a "semicircle" manner to spray the periphery of a mission tile as it is passes lengthwise by said conveyor.

* * * * *